US009221642B2

(12) United States Patent
Mochizuki

(10) Patent No.: US 9,221,642 B2
(45) Date of Patent: Dec. 29, 2015

(54) PAPER TRANSPORT DEVICE, AND DOCUMENT TRANSPORT DEVICE AND IMAGE FORMING APPARATUS INCLUDING THE SAME

(71) Applicant: KYOCERA Document Solutions Inc., Osaka-shi, Osaka (JP)

(72) Inventor: Masayuki Mochizuki, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 14/681,121

(22) Filed: Apr. 8, 2015

(65) Prior Publication Data

US 2015/0291379 A1 Oct. 15, 2015

(30) Foreign Application Priority Data

Apr. 15, 2014 (JP) ..... 2014-083846

(51) Int. Cl.
*B65H 29/58* (2006.01)
*B65H 29/60* (2006.01)

(52) U.S. Cl.
CPC ..... *B65H 29/60* (2013.01); *B65H 29/58* (2013.01); *B65H 2301/448* (2013.01); *B65H 2404/63* (2013.01); *B65H 2404/632* (2013.01); *B65H 2515/50* (2013.01); *B65H 2515/704* (2013.01); *B65H 2601/125* (2013.01); *B65H 2601/524* (2013.01)

(58) Field of Classification Search
CPC .. B65H 29/58; B65H 29/60; B65H 2301/448; B65H 2404/63; B65H 2404/632; B65H 2515/704; B65H 2515/50; B65H 2601/524; B65H 2601/125
See application file for complete search history.

(56) References Cited

U.S. PATENT DOCUMENTS

2008/0054544 A1* 3/2008 Calverley ..... B65H 1/06 270/58.02
2009/0108517 A1* 4/2009 Guerand ..... B65H 29/58 271/225
2011/0233855 A1* 9/2011 Herczeg ..... B65H 7/00 271/255
2013/0156479 A1* 6/2013 Nara ..... B65H 29/58 399/401
2014/0159303 A1* 6/2014 Suzuki ..... G03G 15/234 271/225

FOREIGN PATENT DOCUMENTS

JP 07196180 A * 8/1995
JP 2001322734 A 11/2001
JP 2007173709 A * 7/2007

* cited by examiner

*Primary Examiner* — Jeremy R Severson

(57) ABSTRACT

A paper transport device includes a transport motor, a branch motor, and a processing unit. In order to generate a holding torque in the branch motor while the transport motor is rotating, the processing unit supplies the exciting current of a first current value to the branch motor in a first time period including the start of the rotation of the transport motor and an acceleration period of the rotation. In a second time period following the first time period and including a stable period in which a rotational speed of the transport motor is stable, the processing unit supplies the exciting current of a second current value, the absolute value of which is smaller than that of the first current value, to the branch motor.

7 Claims, 9 Drawing Sheets

FIG.8

| ENVIRONMENTAL TEMPERATURE (° C) | LENGTH OF FIRST TIME PERIOD | MAGNITUDE OF EXCITING CURRENT(A) D1 | |
|---|---|---|---|
| | | FIRST TIME PERIOD THIRD TIME PERIOD (FIRST, THIRD CURRENT VALUES) | SECOND TIME PERIOD (SECOND CURRENT VALUES) |
| t<5 | 2X | 1.0 | 0.7 |
| 5≦t<10 | 1.5X | 0.9 | 0.6 |
| 10≦t<15 | X | 0.8 | 0.6 |
| 15≦t<20 | 0.75X | 0.7 | 0.5 |
| 20≦t | 0.5X | 0.6 | 0.5 |

PAPER TRANSPORT DEVICE, AND DOCUMENT TRANSPORT DEVICE AND IMAGE FORMING APPARATUS INCLUDING THE SAME

INCORPORATION BY REFERENCE

The disclosure of Japanese Patent Application No. 2014-83846 filed on Apr. 15, 2014 including the specification, drawings and abstract is incorporated herein by reference in its entirety.

BACKGROUND

The present disclosure relates to paper transport devices, document transport devices, and image forming apparatuses which include a guide for switching between paper transport paths using a motor.

In an image forming apparatus such as a multifunctional peripheral, a copier, a printer, or a facsimile machine, motors are used to rotate rotary bodies for transporting paper as well as rotary bodies such as drums for forming toner images. In transporting sheets of paper, the torque required for transporting a sheet (the sufficient magnitude of torque which causes no step-out) varies depending on the thickness of the sheet.

For example, a typical image forming apparatus adopts a technique of controlling a current which is caused to flow through a stepping motor according to the thickness of the sheet of paper. Specifically, in this technique, a stepping motor is used to transport-drive the paper. The thickness of a target sheet of paper on which an image is to be formed is detected, and the drive current value for constant-current chopping control, by which the excitation phase of the stepping motor is sequentially switched to obtain a constant drive current, is variably controlled according to whether the target sheet is thick or not. With this configuration, in the case of forming an image on a thick sheet of paper, the current of a necessary and sufficient amount is caused to flow through the motor, to thereby allow the motor to output sufficient torque to transport the sheet without causing step-out.

SUMMARY

In an aspect of the present disclosure, a paper transport device includes a transport rotary body, a transport motor, a branch guide, a branch motor, and a processing unit. The transport rotary body is rotated to transport a sheet of paper along a path. The transport motor rotates the transport rotary body. The branch guide is rotated to switch between paper transport paths. The branch motor rotates the branch guide. The processing unit controls rotation and stopping of the transport motor, rotation and stopping of the branch motor, and the magnitude of an exciting current supplied to the branch motor. While the sheet is transported with the rotation of the transport motor started, in the case of keeping the branch guide in a stationary state, the processing unit performs the following processing. In order to generate a holding torque in the branch motor while the transport motor is rotating, the processing unit supplies the exciting current of a first current value to the branch motor in a first time period including the start of the rotation of the transport motor and an acceleration period of the rotation. In a second time period following the first time period and including a stable period in which a rotational speed of the transport motor is stable, the processing unit supplies the exciting current of a second current value, the absolute value of which is smaller than that of the first current value, to the branch motor.

BRIEF DESCRIPTION OF THE DRAWINGS

FIG. 8 shows an exemplary way of adjusting the exciting current in accordance with environmental temperature.

DETAILED DESCRIPTION

A document transport device 2 including a paper transport device 1 according to an embodiment, and an image forming apparatus will be described below with reference to FIGS. 1 to 9. As an example of the image forming apparatus, a multifunctional peripheral 100 will be described. The configurations, arrangements, and other elements described in the following embodiment are merely illustrative; they are not intended to limit the scope of the disclosure.

<Outline of Multifunctional Peripheral 100>

Figure 1:
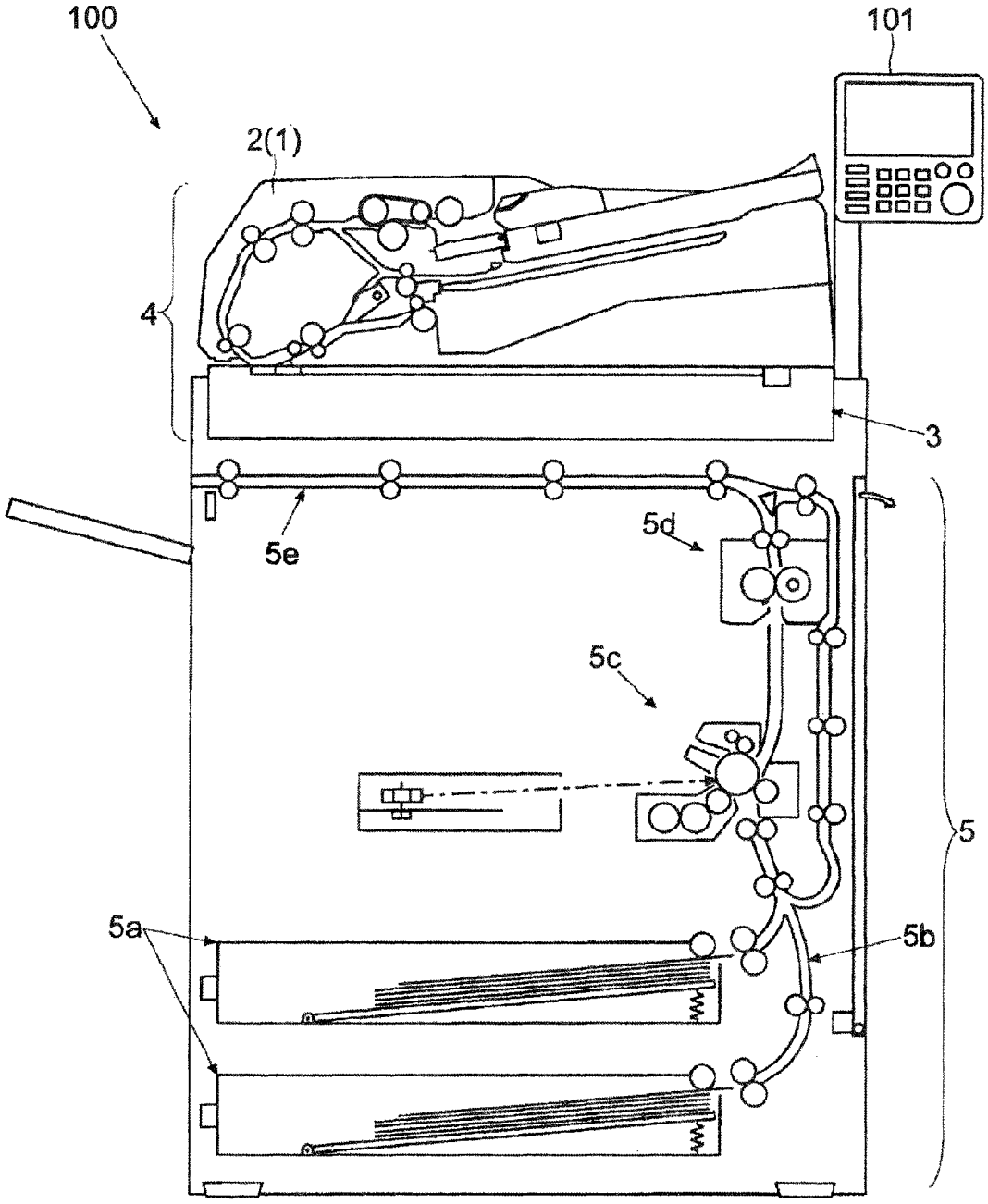
FIG. 1 shows the configuration of a multifunctional peripheral.

First, the multifunctional peripheral 100 according to an embodiment will be outlined with reference to FIG. 1. FIG. 1 shows the configuration of the multifunctional peripheral 100.

As shown in FIG. 1, the multifunctional peripheral 100 of the present embodiment has an operation panel 101 attached to its upper right side. The multifunctional peripheral 100 has, in its upper portion, a reading unit 4 which includes a document transport device 2, including a paper transport device 1 according to the present disclosure, and an image reading device 3. The multifunctional peripheral 100 has a printing unit 5 inside. The printing unit 5 includes a paper feed unit 5*a*, a first transport unit 5*b*, an image forming unit 5*c*, a fixing unit 5*d*, and a second transport unit 5*e*.

The operation panel 101 first accepts various operations. For example, it accepts settings regarding whether to read both sides or singe side of a document d (see FIG. 5; this corresponds to "paper"), whether to copy on one side or both sides of paper, etc. Further, it accepts an instruction (operation of a start key) to start execution of a scanning or copying job.

The printing unit 5 will be described. The paper feed unit 5*a* stores a plurality of sheets of paper, and feeds a sheet for printing. The first transport unit 5*b* transports the sheet supplied from the paper feed unit 5*a*, to the image forming unit 5*c*. The image forming unit 5*c* forms a toner image on the basis of the image data to be printed, and transfers the toner image onto the sheet. The fixing unit 5*d* applies heat and pressure to the sheet with the toner image transferred thereon, to fix the toner image on the sheet. The second transport unit 5*e* discharges the sheet that has passed through the fixing unit 5*d*, to the outside of the apparatus.

<Hardware Configuration of Multifunctional Peripheral 100>

Next, the hardware configuration of the multifunctional peripheral 100 according to the embodiment will be described with reference to FIG. 2.

Figure 2:
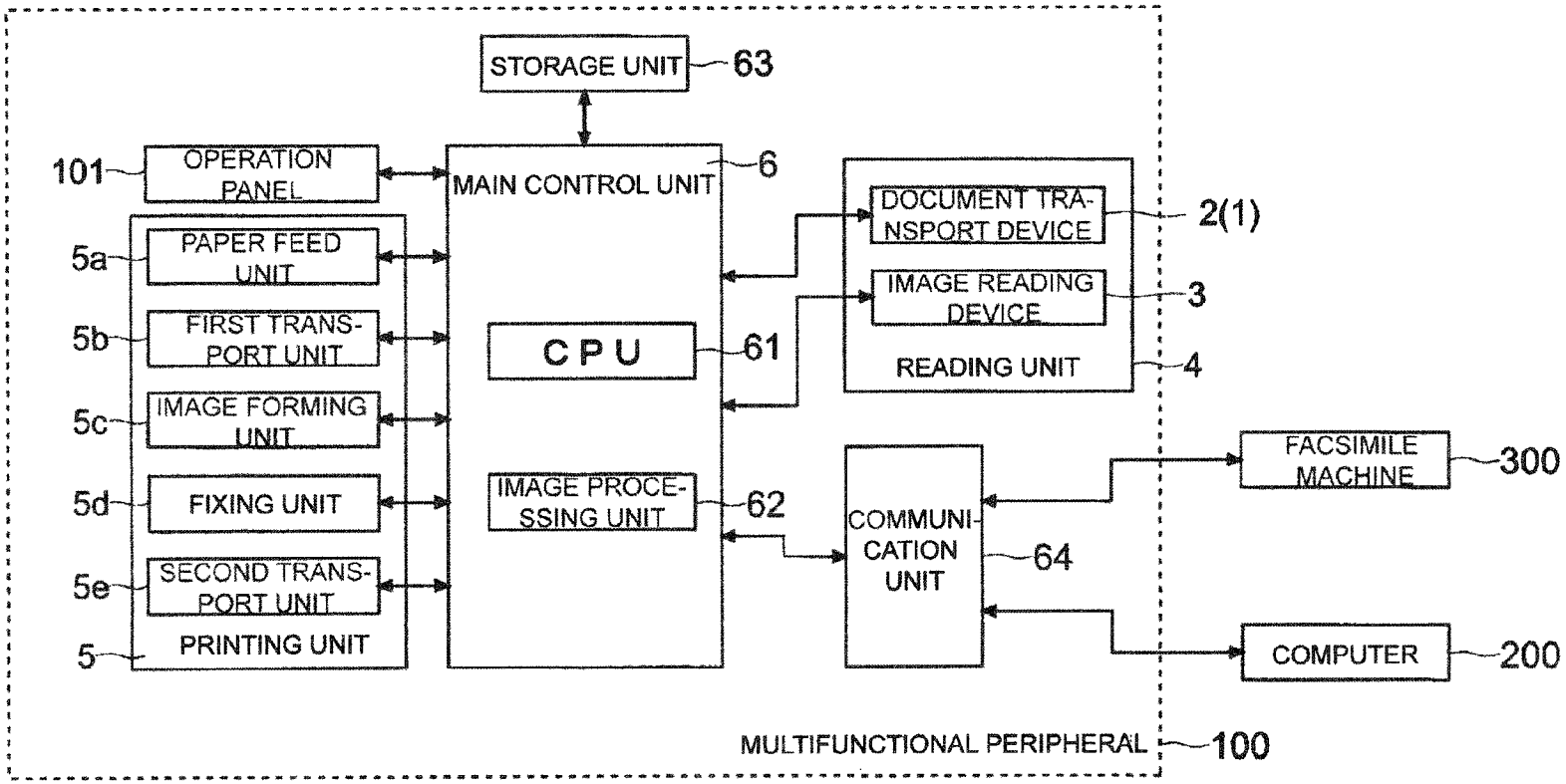
FIG. 2 shows the hardware configuration of the multifunctional peripheral.

As shown in FIG. 2, the multifunctional peripheral 100 according to the present embodiment includes a main control unit 6. The main control unit 6 controls the units and components included in the multifunctional peripheral 100. The main control unit 6 includes a CPU 61, an image processing unit 62 which performs image processing on the image data for use in printing or transmitting, and other electronic circuits and elements. The CPU 61 performs arithmetic processing and control of the units and components in the multifunctional peripheral 100, on the basis of a control program or controlling data stored in a storage unit 63. The storage unit 63 is a combination of a non-volatile storage device such as a ROM, a flash ROM, or a HDD, and a volatile storage device such as a RAM.

The main control unit 6 gives operation instructions to the printing unit 5 (paper feed unit 5*a*, first transport unit 5*b*, image forming unit 5*c*, fixing unit 5*d*, and second transport unit 5*e*) and the reading unit 4. The main control unit 6 causes the printing unit 5 to perform printing (copying function, printing function), on the basis of print data received from a computer 200, or on the basis of the image data that the reading unit 4 has obtained by reading a document.

The main control unit 6 is connected with a communication unit 64. The main control unit 6 controls operations and communication processing by the communication unit 64. The communication unit 64 is an interface for communicating with the computer 200 such as a personal computer or a server, and with a facsimile machine 300. The main control unit 6 also controls display and other operations of the operation panel 101. The main control unit 6 recognizes the operations and settings input to the operation panel 101, and recognizes the content of the settings, print execution instruction, and the like.

<Reading Unit 4>

Figure 3:
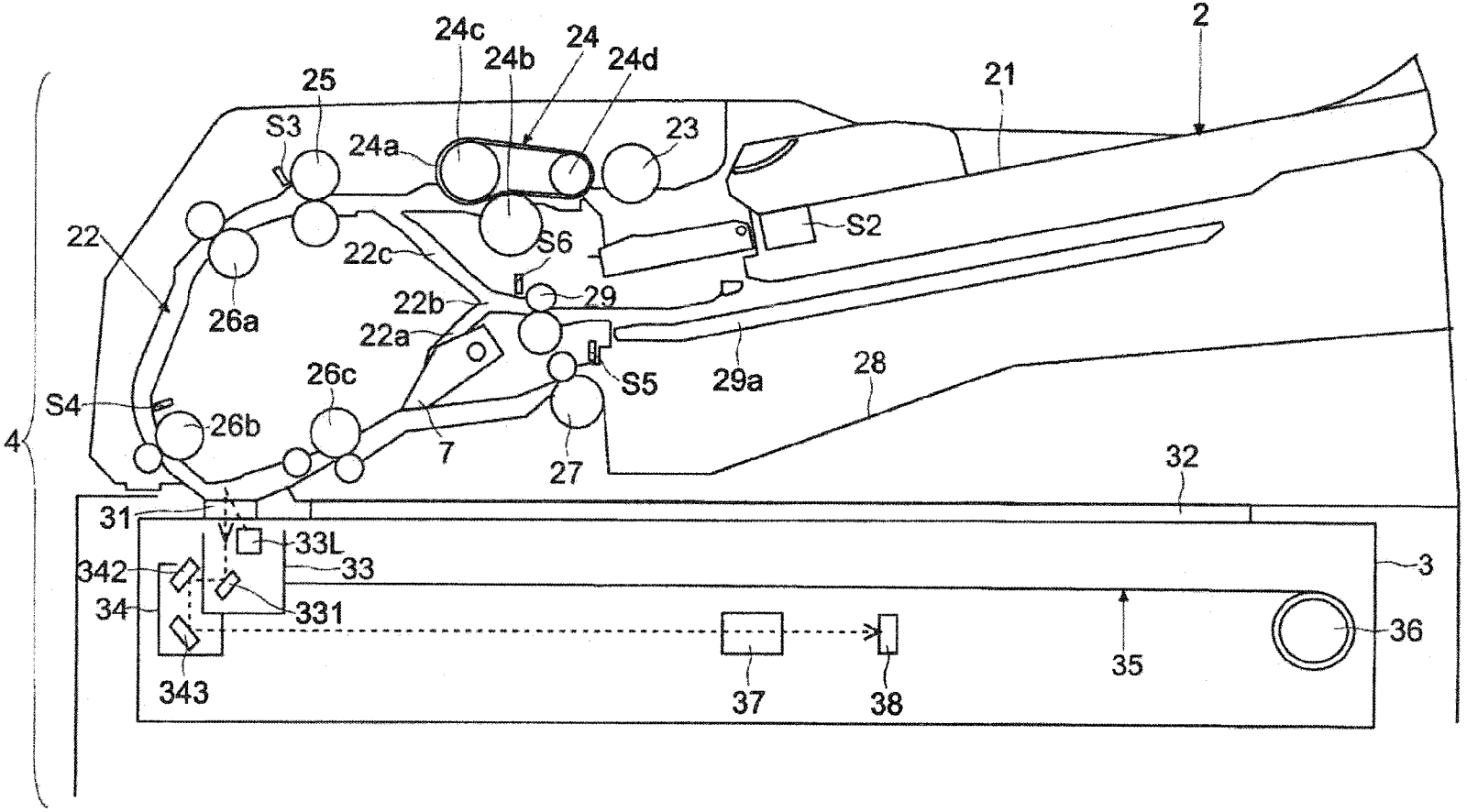
FIG. 3 is an enlarged view of a reading unit.

The reading unit 4 according to the embodiment will now be described with reference to FIG. 3. FIG. 3 is an enlarged view of the reading unit 4.

The reading unit 4 includes the document transport device 2. The document transport device 2 is disposed on top of the image reading device 3. The document transport device 2 transports a document d (corresponding to the paper) toward a reading position (toward a transported-document reading contact glass 31 of the image reading device 3). The document transport device 2 is attached to the image reading device 3 on the deep side of the paper plane of FIG. 1 or 3, so that it is pivotally moved upward or downward to uncover or cover the upper surface of the image reading device 3. That is, the document transport device 2 serves as a cover that covers, from above, glasses (the transported-document reading contact glass 31 and a placed-document reading contact glass 32) of the image reading device 3.

As shown in FIG. 3, the document transport device 2 includes a document tray 21 on which a document d is placed. The document tray 21 is connected to an upstream side end of a document transport path 22. The document transport device 2 includes, in order from the upstream side of the document transport path 22, a pickup roller 23, a separation transport unit 24, a registration roller pair 25 (corresponding to the transport rotary body), a plurality of transport roller pairs 26*a* to 26*c* (each corresponding to the transport rotary body), a discharge roller pair 27 (corresponding to the transport rotary body), and a document discharge tray 28. The document transport device 2 automatically feeds sheets of documents d set on the document tray 21 sequentially onto the document transport path 22, transports each document d along the document transport path 22, and finally discharges the document d onto the document discharge tray 28. The transported-document reading contact glass 31 of the image reading device 3 is located on the way of the document transport path 22. The image reading device 3 reads the document d that passes over the transported-document reading contact glass 31 (the position above the transported-document reading contact glass 31 corresponds to the reading position).

The pickup roller 23 picks up a document d placed on the document tray 21 and supplies the document d to the document transport path 22 and the separation transport unit 24. The pickup roller 23 is driven to rotate by the rotation of a paper feed motor M0 (see FIG. 4). The separation transport unit 24 includes a paper feed belt 24*a* and a separation roller 24*b*. The paper feed belt 24*a* transports the document d, fed from the pickup roller 23, to the downstream side in the document transport direction. The paper feed belt 24*a* is wound around a driving roller 24*c* and a driven roller 24*d*. The driving roller 24*c* is driven to rotate by the rotation of the paper feed motor M0. (Another motor for rotating the driving roller 24*c* may be provided). The rotation of the driving roller 24*c* causes the paper feed belt 24*a* to circulate. The separation roller 24*b* is arranged to face the paper feed belt 24*a*. The separation roller 24*b* is driven to rotate by the rotation of a separation motor M1 (see FIG. 4). When two or more sheets of documents d are fed in an overlapped state (upon occurrence of multiple feed), the separation roller 24*b* separates the underlying sheet(s) of document(s) d out of the overlapped sheets of documents d, and feeds the separated sheet(s) back toward the document tray 21.

The registration roller pair 25 temporarily stops the movement of the document d from the upstream side toward the downstream side of the document transport path 22. In other words, when the leading edge of the document d reaches the registration roller pair 25, the registration roller pair 25 is not rotating. Thus, as the document d abuts against the nip of the registration roller pair 25, the document d warps or bends, so the inclined state of the document d is corrected. After the document d has bent enough for its inclined state to be corrected, the registration roller pair 25 starts rotating, to feed the document d downstream. The registration roller pair 25 is driven by a transport motor M2 (see FIG. 4). On a drive transmission path between the transport motor M2 and the registration roller pair 25, a registration clutch C1 is provided (see FIG. 4), which is engaged or disengaged to transmit or interrupt the drive, for controlling rotation and stopping of the registration roller pair 25.

The transport roller pairs 26*a* to 26*c* each transport a document d (from the upstream side to the downstream side) along the transport direction of the document d. The discharge roller pair 27 discharges the document d that has been read, onto the document discharge tray 28. The transport roller pairs 26*a* to 26*c* and the discharge roller pair 27 are driven by the transport motor M2.

Here, a branch guide 7 is provided between the transport roller pair 26*c* and the discharge roller pair 27. The branch guide 7 is rotated to switch between the transport paths of the document d. In other words, the path for transporting the document d branches in the vicinity of the position where the branch guide 7 is disposed. The document transport device 2 includes a branch motor M7 (see FIG. 4) for rotating the branch guide 7. In the case of performing double-sided reading of a document d, the branch guide 7 is rotated to guide the document d, one side of which has been read, to a reverse transport path 22*a* for reversing the front and back of the document d. In the case of performing single-sided reading of a document d, the branch guide 7 remains unmoved in the state where it closes the entrance to the reverse transport path 22*a* from the document transport path 22.

The reverse transport path 22*a* is equipped with a reverse roller pair 29 which rotates both in the positive and negative directions. The reverse roller pair 29 is driven to rotate by the rotation of the transport motor M2. The reverse transport path 22*a* includes: a section which extends from the branching position between the transport roller pair 26*c* and the discharge roller pair 27 to the reverse roller pair 29; and a section, called a merging transport path 22*c*, which originates from a branching point 22*b* located in the middle of the above-described section from the branching position between the transport roller pair 26*c* and the discharge roller pair 27 to the reverse roller pair 29 and merges into the document transport path 22 on the upstream side of the registration roller pair 25.

The image reading device 3 will now be described. As shown in FIGS. 1 and 3, the image reading device 3 has a box-shaped casing. As also shown in FIG. 3, the image reading device 3 includes, inside the casing, a first moving frame 33, a second moving frame 34, wire 35, a winding drum 36, a lens 37, and an image sensor 38 which receives light reflected from a document d to read the document d, line by line, and generate image data.

The first moving frame 33 includes a light source 33L which irradiates a document d with light, and a first mirror 331. The second moving frame 34 includes a second mirror 342 and a third mirror 343. The light source 33L is a lamp (for example, an LED or a cold cathode tube) which emits light over the main-scanning direction. A plurality of pieces of wire 35 are attached to the first moving frame 33 and the second moving frame 34 (only one piece of wire is shown in FIG. 3 for convenience sake). The other end of each wire 35 is connected to the winding drum 36. The winding drum 36 is driven to rotate in both directions by the rotation of a motor (not shown). This makes it possible to freely move the first moving frame 33 and the second moving frame 34 in the horizontal direction (right-and-left direction of the reading unit 4) to thereby move the position irradiated with the light source 33L (the position of the reading line).

The light emitted from the light source 33L impinges on the document d on each contact glass. In the case of reading a document d while it is being transported by the document transport device 2, the motor drives to fixedly set the first moving frame 33 and the second moving frame 34 at the position (reading position) beneath the transported-document reading contact glass 31. On the other hand, in the case of reading a document d placed on the placed-document reading contact glass 32, the first moving frame 33 and the second moving frame 34 are moved from their home positions horizontally in the right direction in FIG. 3 by the winding drum 36 and the wires 35. The first mirror 331, the second mirror 342, and the third mirror 343 guide the light reflected from the document d to the lens 37. The lens 37 collects the reflected light and guides the light such that it enters the image sensor 38. The image reading device 3 generates image data of the document d on the basis of the output from the image sensor 38.

<Hardware Configuration of Document Transport Device 2>

Figure 4:
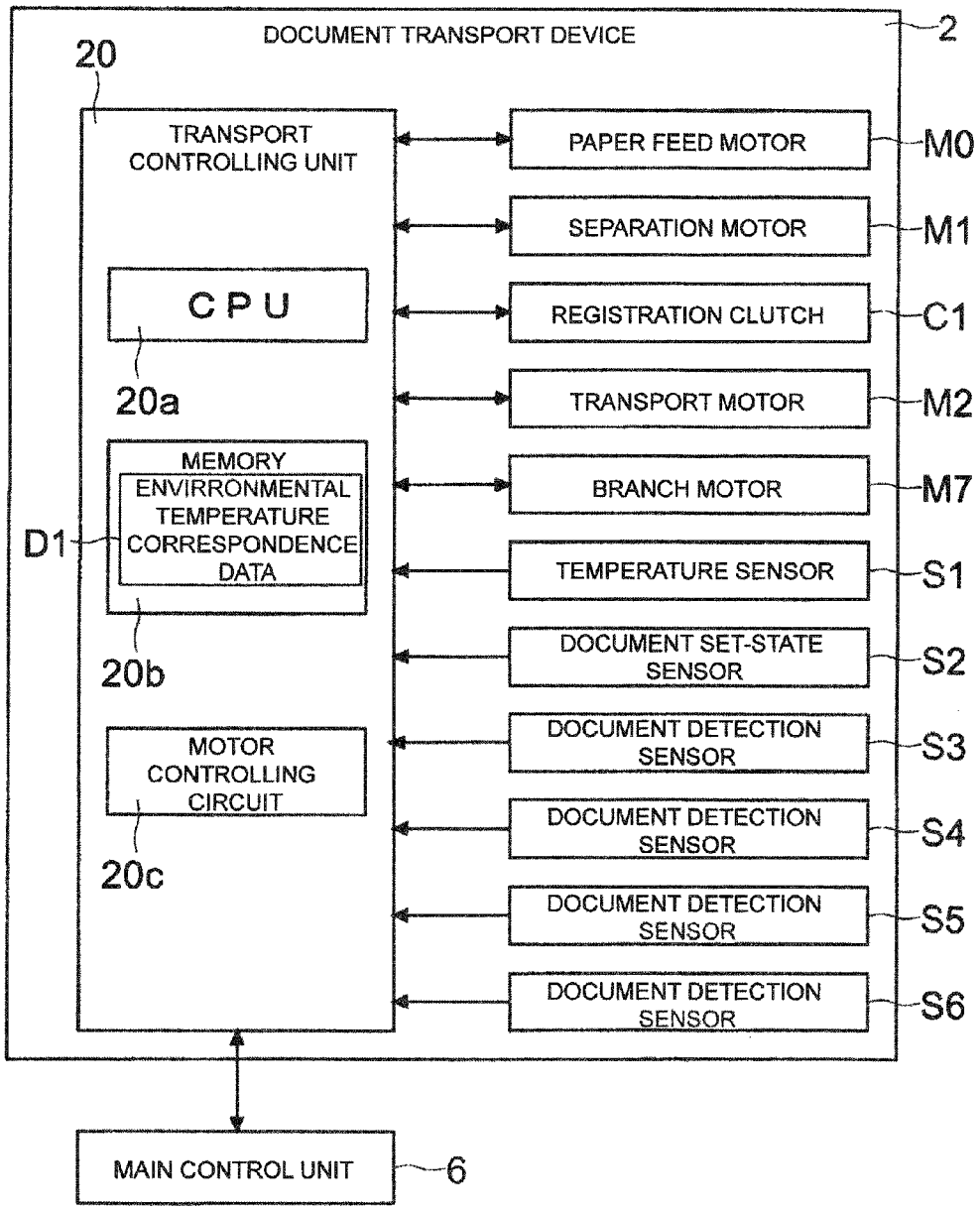
FIG. 4 shows the hardware configuration of a document transport device according to an embodiment.

The document transport device 2 will now be described with reference to FIG. 4. FIG. 4 shows the hardware configuration of the document transport device 2 according to the embodiment.

As shown in FIG. 4, the document transport device 2 includes a transport controlling unit 20 (corresponding to the processing unit) connected to the main control unit 6. The transport controlling unit 20 includes a CPU 20*a*, a memory 20*b* (RAM and ROM), and a motor controlling circuit 20*c*. The motor controlling circuit 20*c* is a circuit (motor driver IC) which controls rotation and stopping as well as rotational speed of each motor included in the document transport device 2. The transport controlling unit 20 is, for example, a substrate including CPU, RAM, ROM, microcomputer, input/output terminals, and motor controlling circuit.

The document transport device 2 includes the drive sources for transporting documents and the member for transmitting the drive, which are: the paper feed motor M0, the separation motor M1, the transport motor M2, the registration clutch C1, and the branch motor M7. When the transport controlling unit 20 receives, from the main control unit 6, an instruction to execute a job involving document reading processing, the transport controlling unit 20 controls the operations of the above motors and clutch to cause them to transport the document d.

More specifically, in the case of transporting and reading a document d placed on the document tray 21 for the copying or transmitting job, the main control unit 6 outputs a document transport instruction to the transport controlling unit 20. In response to the instruction from the main control unit 6, the transport controlling unit 20 actually controls the document transport operations. The transport controlling unit 20 controls the driving of the paper feed motor M0, the separation motor M1, the transport motor M2, the registration clutch C1, and the branch motor M7. The transport controlling unit 20 controls the rotations and rotational speeds of the motors as well as ON/OFF of the clutch.

The document transport device 2 also includes a temperature sensor S1 (corresponding to the temperature detecting body) for detecting a surrounding environmental temperature. The transport controlling unit 20 recognizes the temperature on the basis of the output from the temperature sensor S1 and data stored in the memory 20*b* which defines the temperature with respect to the output from the temperature sensor S1. It should be noted that the main control unit 6 may recognize the surrounding environmental temperature on the basis of the output value of the temperature sensor S1. In this case, the transport controlling unit 20 receives form the main control unit 6 the result of detection of the surrounding environmental temperature. The temperature sensor for detecting the surrounding environmental temperature may be disposed, not inside the document transport device 2, but in a different position in the multifunctional peripheral 100.

The document transport device 2 also includes a document set-state sensor S2 which detects whether there is a document d placed (or, set) on the document tray 21. An output from the document set-state sensor S2 differs depending on whether a document d is set on the document tray 21 or not. The document set-state sensor S2 is, for example, a transmissive photosensor. The transport controlling unit 20 recognizes whether a document d has been set on the document tray 21 or not, on the basis of the output from the document set-state sensor S2.

In the document transport device 2, a plurality of document detection sensors S3 to S6 are provided along the document transport path 22. Each of the document detection sensors S3 to S6 generates different outputs depending on whether it has detected the presence of a document d or not (depending on the presence or absence of document d). The document detection sensors S3 to S6 are, for example, transmissive photosensors.

In the multifunctional peripheral 100 (the document transport device 2) of the present embodiment, the document detection sensors S3 to S6 are arranged on the downstream side of the registration roller pair 25 (S3), on the upstream side of the transport roller pair 26*b* disposed ahead of the reading position (S4), at the discharge roller pair 27 (S5), and near the reverse roller pair 29 (on its upstream side; S6). The transport controlling unit 20 recognizes whether a document d has reached or passed through the point where each document detection sensor S3, S4, S5, S6 is positioned, on the basis of the output from the corresponding document detection sensor. Further, the transport controlling unit 20 recognizes jamming of the document d by not detecting the arrival or passage of the document d within a predetermined period of time.

<Document Transportation Flow for Double-Sided Reading>

Figure 5:
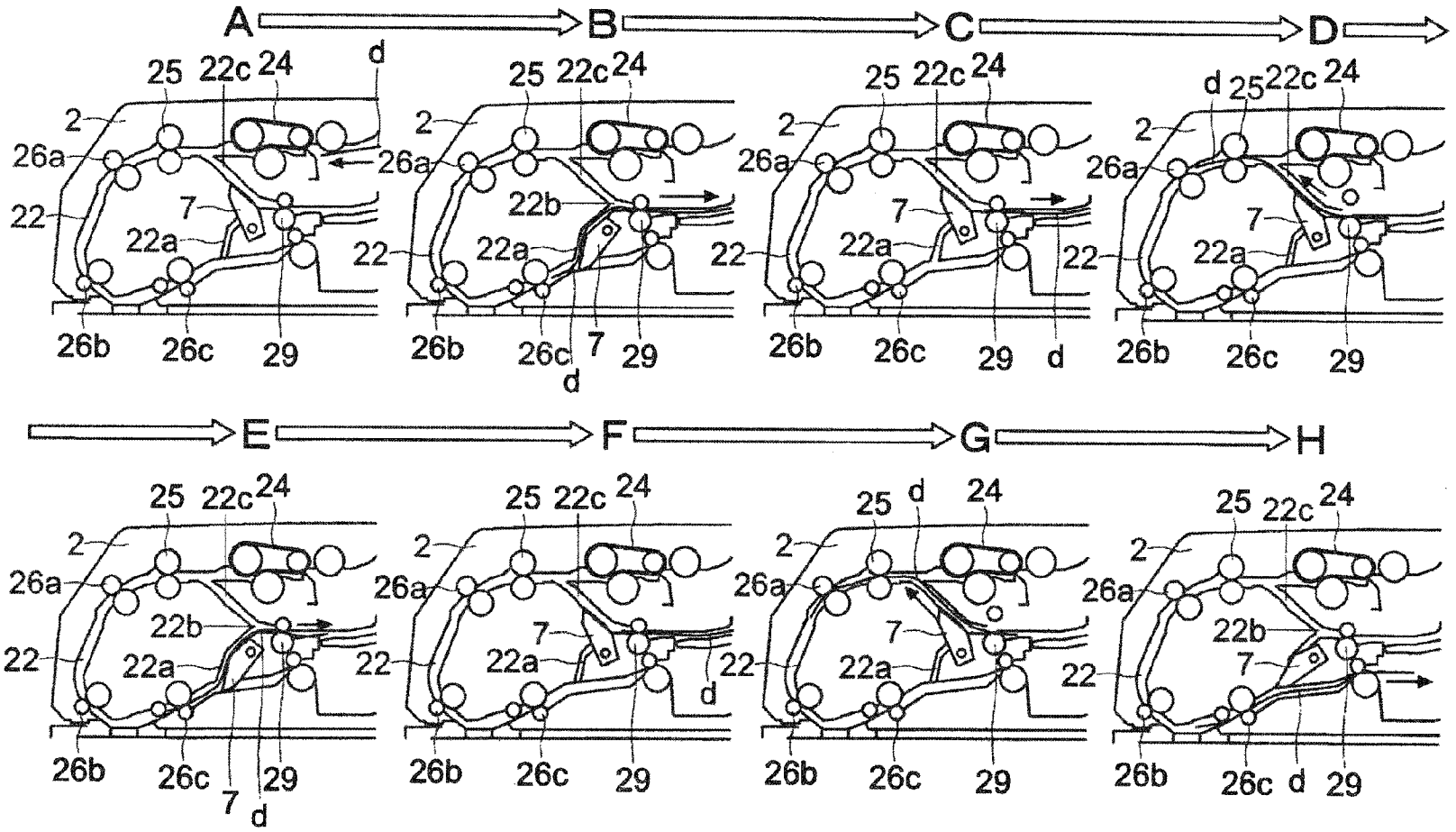
FIG. 5 shows, by way of example, how a document is transported for double-sided reading.

An exemplary transportation flow of a document in the case of double-sided reading will now be described with reference to FIG. 5. In FIG. 5, the document transportation flow for double-sided reading is indicated in the alphabetical order of: A→B→C→D→E→F→G→H. Further, in FIG. 5, the transport direction of a document d is indicated by black arrows.

First, A in FIG. 5 shows the time point when the document d placed on the document tray 21 is to be sent out. The transport controlling unit 20 causes the paper feed motor M0 and the separation motor M1 to rotate, to send the document d onto the document transport path 22.

Following the state in A above, B in FIG. 5 shows the state where, after the front surface of the document d has been read, the transport controlling unit 20 causes the branch motor M7 to operate to rotate the branch guide 7 to the position where it guides the document d to the reverse transport path 22*a*. It also shows the state where, for reversing the front and back of the document d guided onto the reverse transport path 22*a*, the transport controlling unit 20 causes the transport motor M2 to rotate, to thereby cause the reverse roller pair 29 arranged on the reverse transport path 22*a* to transport the document d toward a reverse tray 29*a*. The reverse tray 29*a* is arranged inside the document transport device 2, beneath the document tray 21. The paper to be reversed is guided to the reverse tray 29*a* (see FIG. 3).

Following the state in B above, C in FIG. 5 shows the state where the transport controlling unit 20 has caused the transport motor M2 (the reverse roller pair 29) to stop after the tail end of the document d has come to the reverse roller pair 29 side past the branching point 22*b* and before the tail end of the document d exits from the nip of the reverse roller pair 29 in the direction of the reverse tray 29*a*. Thereafter, in order to cause the document d to re-enter the document transport path 22 from the upstream side of the registration roller pair 25 (i.e. from the merging transport path 22*c*), the transport controlling unit 20 causes the transport motor M2 to rotate in the opposite direction. This causes the reverse roller pair 29 to transport the document d by pulling it out of the reverse tray 29*a*, whereby the document d is switched back. The transport controlling unit 20 causes the branch motor M7 to operate to rotate the branch guide 7 to the position where it guides the document d toward the merging transport path 22*c*, while blocking the transport path toward the transport roller pair 26*c* (path guiding the document d to the reverse tray 29*a*).

The transport motor M2 rotates the reverse roller pair 29. The reverse roller pair 29 rotates in accordance with the rotating direction of the transport motor M2. When the transport motor M2 is rotating in the positive direction, the reverse roller pair 29 rotates in the direction of sending the document d onto the reverse tray 29*a*. When the transport motor M2 is rotating in the opposite direction, the reverse roller pair 29 rotates in the direction of pulling the document d out of the reverse tray 29*a* and transporting it toward the registration roller pair 25.

Further, the transport motor M2 rotates the registration roller pair 25, the transport roller pairs 26*a* to 26*c*, and the discharge roller pair 27. On the drive transmission paths from the transport motor M2 to the transport roller pairs 26*a* to 26*c* and the discharge roller pair 27, a one-way clutch is provided for each rotary body. Thus, while the transport motor M2 is rotating in the opposite direction, each rotary body is not rotated (no drive is transmitted). While the transport motor M2 is rotating in the positive direction, the transport roller pairs 26*a* to 26*c* and the discharge roller pair 27 rotate so as to transport the document d toward the downstream of the document transport path 22 (toward the document discharge tray 28).

Following the state in C above, D in FIG. 5 shows the state where the reversed document d is transported by the registration roller pair 25 toward the downstream of the document transport path 22. When the document d reaches the registration roller pair 25, the transport controlling unit 20 switches the rotating direction of the transport motor M2 from the opposite direction to the positive direction. At this time, to avoid the reverse roller pair 29 from obstructing the transportation, one or both of the rollers of the reverse roller pair 29 is/are moved to release the nip (increase the space therebetween). D in FIG. 5 shows the state where, of the reverse roller pair 29, the upper roller has been separated from the lower roller. For separating the rollers, a solenoid, for example, can be provided. The transport controlling unit 20 uses this solenoid to control the contact and separation between the two rollers of the reverse roller pair 29. It should be noted that the transport controlling unit 20 causes the reverse roller pair 29 to attain the state forming the nip again after the document d exits from the reverse roller pair 29.

Following the state in D above, E in FIG. 5 shows the state where, after the back surface of the document d has been read, the transport controlling unit 20 causes the branch motor M7 to operate to rotate the branch guide 7 to the position where it guides the document d to the reverse transport path 22*a*. In order for the document d guided onto the reverse transport path 22*a* to be reversed again, the transport controlling unit 20 causes the transport motor M2 to rotate, to thereby cause the reverse roller pair 29 to transport the document d toward the reverse tray 29*a*. This is for the purposes of switching back the document d again for discharging the document d in the state where it faces the same side as that when the document transportation was started.

Following the state in E above, F in FIG. 5 shows the state where the transport controlling unit 20 has caused the transport motor M2 (the reverse roller pair 29) to stop after the tail end of the document d has come to the reverse roller pair 29 side past the branching point 22*b* and before the tail end of the document d exits from the nip of the reverse roller pair 29 in the direction of the reverse tray 29*a*. Thereafter, in order to cause the document d to re-enter the document transport path 22 from the upstream side of the registration roller pair 25 (i.e. from the merging transport path 22*c*), the transport controlling unit 20 causes the transport motor M2 to rotate in the opposite direction. This causes the reverse roller pair 29 to transport the document d by pulling it out of the reverse tray 29*a*, whereby the document d is switched back for the second time. The transport controlling unit 20 causes the branch motor M7 to operate to rotate the branch guide 7 to the position where it guides the document d toward the merging transport path 22*c* (toward the registration roller pair 25), while blocking the transport path toward the transport roller pair 26*c*.

Following the state in F above, G in FIG. 5 shows the state where the document d is being transported past the registration roller pair 25 toward the downstream of the document transport path 22 (toward the document discharge tray 28). When the document d reaches the registration roller pair 25, the transport controlling unit 20 switches the rotating direction of the transport motor M2 from the opposite direction to the positive direction. At this time as well, to avoid the reverse roller pair 29 from obstructing the transportation, the transport controlling unit 20 causes one or both of the rollers of the reverse roller pair 29 to move to release the nip (increase the space therebetween). G in FIG. 5 shows the state where, of the reverse roller pair 29, the upper roller has been separated from the lower roller.

Following the state in G above, H in FIG. 5 shows the state where the document d is discharged onto the document discharge tray 28. The transport controlling unit 20 causes the branch motor M7 to operate to rotate the branch guide 7 to the position where it guides the document d toward the document discharge tray 28, while blocking the transport path toward the reverse transport path 22*a* (toward the reverse tray 29*a*).

The document transport device 2 includes the transport rotary bodies (the transport roller pairs 26*a* to 26*c*, the registration roller pair 25, the discharge roller pair 27), the transport motor M2, the branch guide 7, the branch motor M7, the transport controlling unit 20, the temperature sensor S1, the document set-state sensor S2, and the document detection sensors S3 to S6. This means that the document transport device 2 includes the paper transport device 1 according to the present disclosure.

<Control of Branch Motor M7 and Transport Motor M2>

Figure 6:
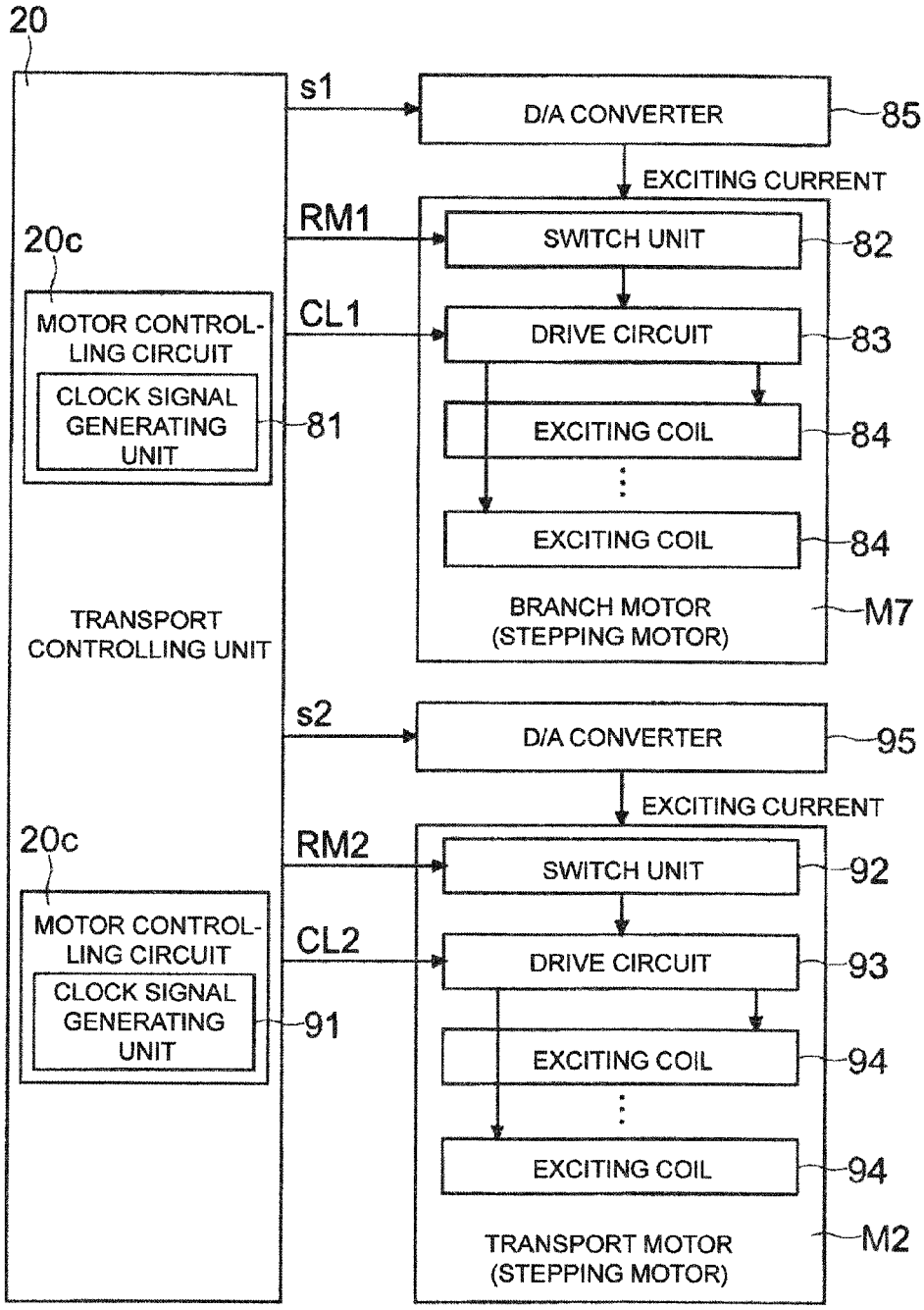
FIG. 6 shows an exemplary configuration for controlling the rotations of a branch motor and a transport motor by a transport controlling unit.

A description will now be made, with reference to FIG. 6, about how the transport controlling unit 20 according to the embodiment controls the rotations of the branch motor M7 and the transport motor M2. FIG. 6 shows an exemplary configuration for controlling the rotations of the branch motor M7 and the transport motor M2 by the transport controlling unit 20.

The control of the branch motor M7 will be described first. As shown in FIG. 6, a stepping motor is used for the branch motor M7 of the present embodiment. The transport controlling unit 20 includes a motor controlling circuit 20*c* which controls the rotation of the branch motor M7. The motor controlling circuit 20*c* includes a clock signal generating unit 81 which generates a clock signal to be input to the stepping motor. In other words, the transport controlling unit 20 generates a clock signal CL1 for the branch motor M7 and inputs the generated signal to the branch motor M7. The clock signal generating unit 81 is able to change the frequency of the clock signal CL1 generated, for acceleration or deceleration of the stepping motor.

The branch motor M7 includes a switch unit 82, a drive circuit 83, and a plurality of exciting coils 84. While two exciting coils 84 are shown in FIG. 6, the number of exciting coils 84 included corresponds to the number of phases of the stepping motor.

The switch unit 82 is a switch controlling whether to cause an exciting current to flow through the exciting coil(s) 84 (whether to energize the branch motor M7). When stopping energization of the branch motor M7, the transport controlling unit 20 inputs to the switch unit 82 a remote signal RM1 indicating that the switch unit 82 is turned off. When energizing the branch motor M7, the transport controlling unit 20 inputs to the switch unit 82 a remote signal RM1 indicating that the switch unit 82 is turned on.

The drive circuit 83 operates to change the exciting coil(s) 84 through which the exciting current is caused to flow, in a predetermined pattern (corresponding to the excitation system such as the one phase excitation, two phase excitation, or 1-2 phase excitation), in accordance with the input clock signal CL1.

A digital-to-analog (D/A) converter 85 is provided, which supplies an exciting current to the branch motor M7. The transport controlling unit 20 gives a designation signal s1, designating the magnitude of the current to be supplied to the exciting coil(s) 84, to the D/A converter 85. The D/A converter 85 supplies the exciting current corresponding to the designation signal s1, to the exciting coil(s) 84. In other words, the transport controlling unit 20 can adjust the output or torque of the branch motor M7 by controlling the exciting current.

The transport motor M2 will now be described. As shown in FIG. 6, a stepping motor is used also for the transport motor M2 of the present embodiment. The transport controlling unit 20 includes the motor controlling circuit 20*c* which also controls the rotation of the transport motor M2. The motor controlling circuit 20*c* includes a clock signal generating unit 91 which generates a clock signal to be input to the transport motor M2. In other words, the transport controlling unit 20 generates a clock signal CL2 for the transport motor M2 and inputs the generated signal to the transport motor M2. The clock signal generating unit 91 is able to change the frequency of the clock signal CL2 generated, for acceleration or deceleration of the stepping motor.

The transport motor M2 includes a switch unit 92, a drive circuit 93, and a plurality of exciting coils 94. While two exciting coils 94 are shown in FIG. 6, the number of exciting coils 94 included corresponds to the number of phases of the stepping motor.

The switch unit 92 is a switch controlling whether to cause an exciting current to flow through the exciting coil(s) 94 (whether to energize the transport motor M2). When stopping energization of the transport motor M2, the transport controlling unit 20 inputs to the switch unit 92 a remote signal RM2 indicating that the switch unit 92 is turned off. When energizing the transport motor M2, the transport controlling unit 20 inputs to the switch unit 92 a remote signal RM2 indicating that the switch unit 92 is turned on.

The drive circuit 93 operates to change the exciting coil(s) 94 through which the exciting current is caused to flow, in a predetermined pattern (corresponding to the excitation system such as the one phase excitation, two phase excitation, or 1-2 phase excitation), in accordance with the input clock signal CL2.

A digital-to-analog (D/A) converter 95 is provided, which supplies an exciting current to the transport motor M2. The transport controlling unit 20 gives a designation signal s2, designating the magnitude of the current to be supplied to the exciting coil(s) 94, to the D/A converter 95. The D/A converter 95 supplies the exciting current corresponding to the designation signal s2, to the exciting coil(s) 94. In other words, the transport controlling unit 20 can adjust the output or torque of the transport motor M2 by controlling the exciting current.

<Vibration Caused by Transport Motor M2 and Keeping Branch Guide 7 Stationary>

Figure 7:
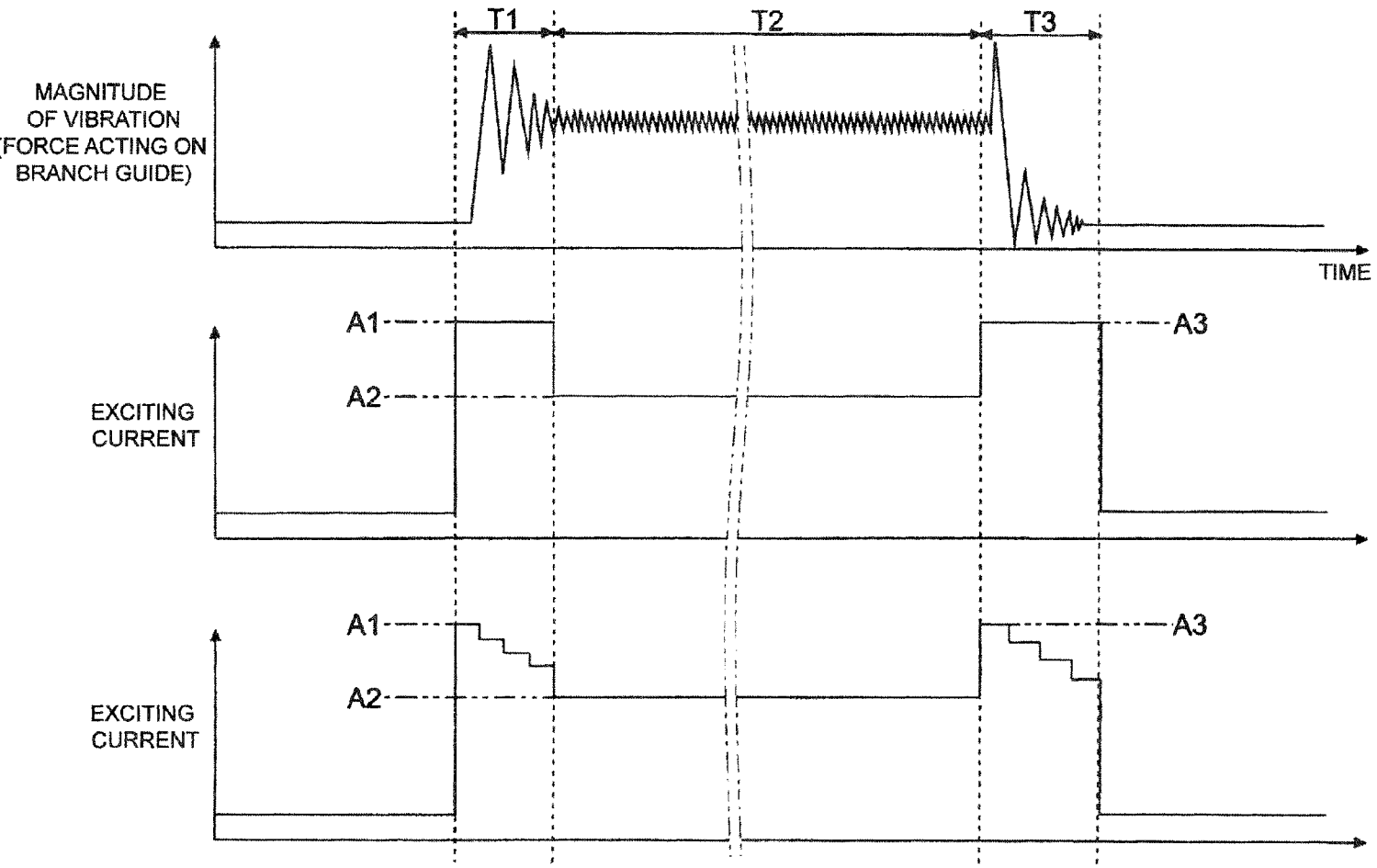
FIG. 7 shows, by way of example, the magnitude of vibration caused by the transport motor and exciting current supplied to the branch motor for keeping a branch guide stationary.

A description will now be made, with reference to FIG. 7, about the vibration caused by the transport motor M2 and the way of keeping the branch guide 7 stationary according to the embodiment. FIG. 7 shows, by way of example, the magnitude of the vibration caused by the transport motor M2 and the exciting current supplied to the branch motor M7 so as to keep the branch guide 7 stationary.

First, the graph at the top in FIG. 7 shows an exemplary relationship between the time and the magnitude of the vibration caused by the transport motor M2 from the start to the end of its rotation.

For transporting a document d, the transport controlling unit 20 causes the transport motor M2 to rotate so as to rotate the rotary bodies such as the transport roller pairs 26*a* to 26*c*. After the transport motor M2 starts rotating, the transport controlling unit 20 accelerates the rotation of the transport motor M2 until the motor attains the rotational speed corresponding to a predetermined transport speed.

When the rotational speed of the transport motor M2 becomes the speed (hereinafter, called the "stable speed") corresponding to the predetermined transport speed, the transport controlling unit 20 causes the transport motor M2 to rotate at the constant speed (stable speed) during the transportation of the document.

In the case of stopping the rotation of the transport motor M2 for reversal of its rotational direction for switching back or for termination of the transportation of the document, the transport controlling unit 20 decreases the frequency of the clock signal CL2 input to the transport motor M2 to reduce its rotational speed and finally stop the transport motor M2.

At the beginning of rotation and during the deceleration for stopping, the torque of the transport motor M2 tends to become large and the vibration of the transport motor M2 tends to increase, as shown in FIG. 7. In other words, in the time period during which the transport motor M2 accelerates from the stopped state, the torque is large and, thus, the magnitude of the vibration of the transport motor M2 may become large, for the following reasons. While the stepping motor is rotating at low speed, it suffers deceleration or stopping at each pulse. This causes the deceleration (swing-back) of the accelerated rotor, so the vibration tends to become large. On the other hand, while the transport motor M2 is rotating at constant speed, the magnitude of the vibration caused thereby becomes constant.

As the magnitude (amplitude) of the vibration of the transport motor M2 is larger, a greater force (causing the branch guide 7 to sway) acts on the branch guide 7. When the force (vibration) acting on the branch guide 7 increases and the branch guide 7 sways to narrow or block the transport path of the document d, the document d becomes jammed.

Thus, in the case of keeping the branch guide 7 in the stationary state, conventionally, an exciting current is supplied to one or more of the exciting coils 84 of the branch motor M7, with the start of rotation of the transport motor M2 (with the start of transportation of the document), to generate a holding torque, thereby preventing the branch guide 7 from moving by the vibration.

During the time in which the branch guide 7 should be kept stationary, conventionally, the exciting current of a constant magnitude is supplied to the branch motor M7, without taking into account the magnitude (amplitude) of the vibration caused by the transport motor M2. Further, in order to make the branch guide 7 unmoved irrespective of the rotational state of the transport motor M2, the magnitude of the exciting current was set to the level enough to keep the branch guide 7 from swaying even with the maximum vibration.

The transport motor M2, however, undergoes acceleration and deceleration, and the vibration caused by the transport motor M2 varies accordingly. As shown in FIG. 7, the vibration of the transport motor M2 becomes relatively large in the time period where the motor is accelerating and in the time period where it is decelerating, while the vibration becomes relatively small as the rotational speed increases to a certain level and the motor comes to rotate stably.

Thus, in the paper transport device 1 (the document transport device 2) of the present embodiment, the transport controlling unit 20 performs control such that the magnitude (absolute value) of the exciting current for keeping the branch guide 7 stationary is decreased in a second time period T2 than in a first time period T1, as will be described below. The magnitude of the exciting current is thus changed in accordance with the magnitude of the vibration of the transport motor M2.

Specifically, the "first time period T1" refers to a time period including the time point when the transport motor M2 started rotating and the acceleration period in which the rotation of the transport motor M2 speeds up. In other words, the "first time period T1" is a time period during which the vibration caused by the transport motor M2 is greater than a predetermined level. The length of the first time period T1 can be determined as appropriate taking into consideration the acceleration characteristic and the vibration characteristic of the transport motor M2.

For example, the beginning of the first time period T1 can be the time point when the transport motor M2 starts rotating. Alternatively, the beginning of the first time period T1 may be a predetermined time (for example, one to several seconds) before the start of the rotation of the transport motor M2.

The end of the first time period T1 can be determined as appropriate. For example, the end of the first time period T1 may be the time point when the rotational speed of the transport motor M2 has become constant (when the frequency of the clock signal CL2 has reached a certain level). Alternatively, the time taken for an obtained vibration to converge to a certain level may be measured through experiments, and the time point when the measured time has elapsed from the start of the rotation may be set as the end of the first time period T1.

The "second time period T2" is a period which follows the first time period T1. The "second time period T2" refers to a time period including the stable period in which the rotational speed of the transport motor M2 is stable (the period in which the motor is rotating at the stable speed). More specifically, the beginning of the second time period T2 follows the end of the first time period T1. The end of the second time period T2 can be determined as appropriate. It may be the time point when the transport motor M2 starts decelerating, or it may be a predetermined time prior to the start of the deceleration of the transport motor M2.

Examples of the changes of the exciting current for keeping the branch guide 7 stationary are shown in the middle and bottom graphs in FIG. 7. In these graphs, the horizontal axis represents time, and the vertical axis represents the magnitude of the exciting current supplied to the branch motor M7.

As shown in the middle and bottom graphs in FIG. 7, the exciting current supplied to the branch motor M7 is set such that a first current value A1 in the first time period T1 becomes larger than a second current value A2 in the second time period T2, so that the holding torque of the branch motor M7 becomes greater in the time period in which the vibration caused by the transport motor M2 is larger.

More specifically, the magnitude (absolute value of the first current value A1) of the exciting current supplied to the branch motor M7 in the first time period T1 is set to the level which ensures that the branch guide 7 is kept stationary even when the magnitude of the vibration caused by the transport motor M2 is the largest. The magnitude (absolute value of the second current value A2) of the exciting current supplied to the branch motor M7 in the second time period T2 is set to the level which ensures that the branch guide 7 is kept stationary even when it receives the vibration from the transport motor M2 rotating in the stable speed.

The middle graph in FIG. 7 shows the example where the magnitude (absolute value) of the exciting current supplied to the branch motor M7 while the transport motor M2 is rotating is changed in two steps. That is, the magnitude is changed from the first current value A1 to the second current value A2. Changing the exciting current in this manner allows the amount of the exciting current supplied to the branch motor M7 for keeping the branch guide 7 stationary to be suppressed compared to the conventional case. It is thus possible to reduce the power consumption during the transportation of a document d.

It should be noted that the transport controlling unit 20 may decrease the magnitude of the exciting current supplied to the branch motor M7 in a plurality of steps, as shown in the bottom graph in FIG. 7, from the exciting current (of the first current value A1) in the first time period T1 to the exciting current (of the second current value A2) in the second time period T2. The bottom graph in FIG. 7 shows the example where the transport controlling unit 20 decreases the exciting current supplied to the branch motor M7 gradually in three steps from the first current value A1 within the first time period T1, and once the second time period T2 is reached, it sets the magnitude of the exciting current supplied to the branch motor M7 to the second current value A2.

Further, in the paper transport device 1 (the document transport device 2) of the present embodiment, the transport controlling unit 20 also increases the exciting current supplied to the branch motor M7 when bringing the transport motor M2 to a stop, compared to the current value in the second time period T2. The middle and bottom graphs in FIG. 7 show a third time period T3, which is a time period including the deceleration period for stopping the transport motor M2, and a third current value A3, which is a current value of the exciting current in the third time period T3. In the document transport device 2 of the present embodiment, the first current value A1 and the third current value A3 are the same (although they may be different from each other).

Specifically, the "third time period T3" is a period which follows the second time period T2. The "third time period T3" refers to a time period including the deceleration period for the transport motor M2 to stop. In other words, the "third time period T3" is a time period in which the vibration caused by the transport motor M2 becomes larger than a predetermined level (the magnitude of the vibration acceptable in the second time period T2). The length of the third time period T3 can be determined as appropriate taking into consideration the deceleration characteristic and the vibration characteristic of the transport motor M2. The beginning of the third time period T3 can be the time point when the deceleration process of the transport motor M2 starts (when the process of decreasing the frequency of the clock signal CL2 starts), or it can be a predetermined time (for example, one to several seconds) before the start of the deceleration process. The end of the third time period T3 can be determined as appropriate. For example, the end of the third time period T3 may be the time point when the frequency of the clock signal CL2 applied to the transport motor M2 has become zero or reached the self-starting frequency. Alternatively, it may be the time point when a predetermined time has elapsed from the beginning of the third time period T3.

As shown in the middle and bottom graphs in FIG. 7, in order to increase the holding torque of the branch motor M7 in the third time period T3 in which the vibration caused by the transport motor M2 increases again due to the deceleration, the transport controlling unit 20 performs control such that the magnitude of the exciting current supplied to the branch motor M7 is increased (to the third current value A3) in the third time period T3 than in the second time period T2.

More specifically, the magnitude (absolute value of the third current value A3) of the exciting current supplied to the branch motor M7 in the third time period T3 is set to the level ensuring that the branch guide 7 is kept stationary during the third time period T3 even when the magnitude of the vibration caused by the transport motor M2 is the largest.

The middle graph in FIG. 7 shows the example where the magnitude (absolute value) of the exciting current supplied to the branch motor M7 is changed directly from the second current value A2 to the third current value A3 upon deceleration of the transport motor M2. Specifically, the magnitude of the exciting current in the third time period T3 is set to be the same as that of the exciting current in the first time period T1.

It should be noted that, as shown in the bottom graph in FIG. 7, the magnitude (absolute value) of the exciting current supplied to the branch motor M7 in the third time period T3 may be decreased from the third current value A3 in a plurality of steps.

<Adjustment of Exciting Current According to Environmental Temperature>

Now, an exemplary way of adjusting the exciting current in accordance with the environmental temperature will be described with reference to FIG. 8. FIG. 8 shows an exemplary way of adjusting the exciting current in accordance with environmental temperature.

As the temperature of the environment in which the multifunctional peripheral 100 is installed is lower, the torque required for starting the rotation of a rotary body such as a roller may become larger. In the document transport device 2 according to the present embodiment, the torque required to start the rotation of the transport motor M2, which rotates the transport roller pairs 26*a* to 26*c* and the discharge roller pair 27, becomes larger with lower temperature. This is because lower temperature causes: contraction of the spindles supporting the rotary shafts of the transport roller pairs 26*a* to 26*c* and the discharge roller pair 27, contraction of the gears, hardening of the grease applied to the gears, and hardening of the document d.

In order to increase the torque, in the document transport device 2 (the multifunctional peripheral 100) of the present embodiment, the transport controlling unit 20 increases the current supplied to the transport motor M2 as the temperature is lower. With the larger torque, however, the vibration caused by the transport motor M2 may become larger.

The transport controlling unit 20 recognizes the temperature of the installation environment of the multifunctional peripheral 100 (the document transport device 2), on the basis of the output from the temperature sensor S1. The transport controlling unit 20 then increases the exciting current supplied to the branch motor M7 for keeping the branch guide 7 stationary as the temperature is lower. This can make the holding torque of the branch motor M7 increase with lower temperature. FIG. 8 shows an example in which the magnitude (absolute value) of the exciting current (first current value A1, second current value A2, third current value A3) supplied to the branch motor M7 when keeping the branch guide 7 stationary is made larger as the temperature is lower. While FIG. 8 shows the example of increasing the absolute values of all the first, second, and third current values A1, A2, and A3, the absolute value of only one or two of them may be increased instead.

Further, the period from the start of rotation of the transport motor M2 during which the magnitude of the vibration exceeds a threshold value may continue longer with lower temperature. Thus, the transport controlling unit 20 sets the first time period T1 longer with lower temperature and shorter with higher temperature. FIG. 8 shows such an example in which the first time period T1 is elongated as the temperature is lower. In FIG. 8, "X" denotes a reference length of time of the first time period T1.

Environmental temperature correspondence data D1 which defines the magnitude of the exciting current supplied to the branch motor M7 for keeping the branch guide 7 stationary and the length of the first time period T1 in accordance with the temperature of the installation environment of the multifunctional peripheral 100 (the document transport device 2), as shown in FIG. 8, is stored in the memory 20*b*. In accordance with the detected temperature and the environmental temperature correspondence data D1, the transport controlling unit 20 supplies the exciting current for keeping the branch guide 7 stationary, to the branch motor M7.

<Flow of Supplying Exciting Current to Branch Motor M7 When Keeping Branch Guide 7 Stationary>

Figure 9:
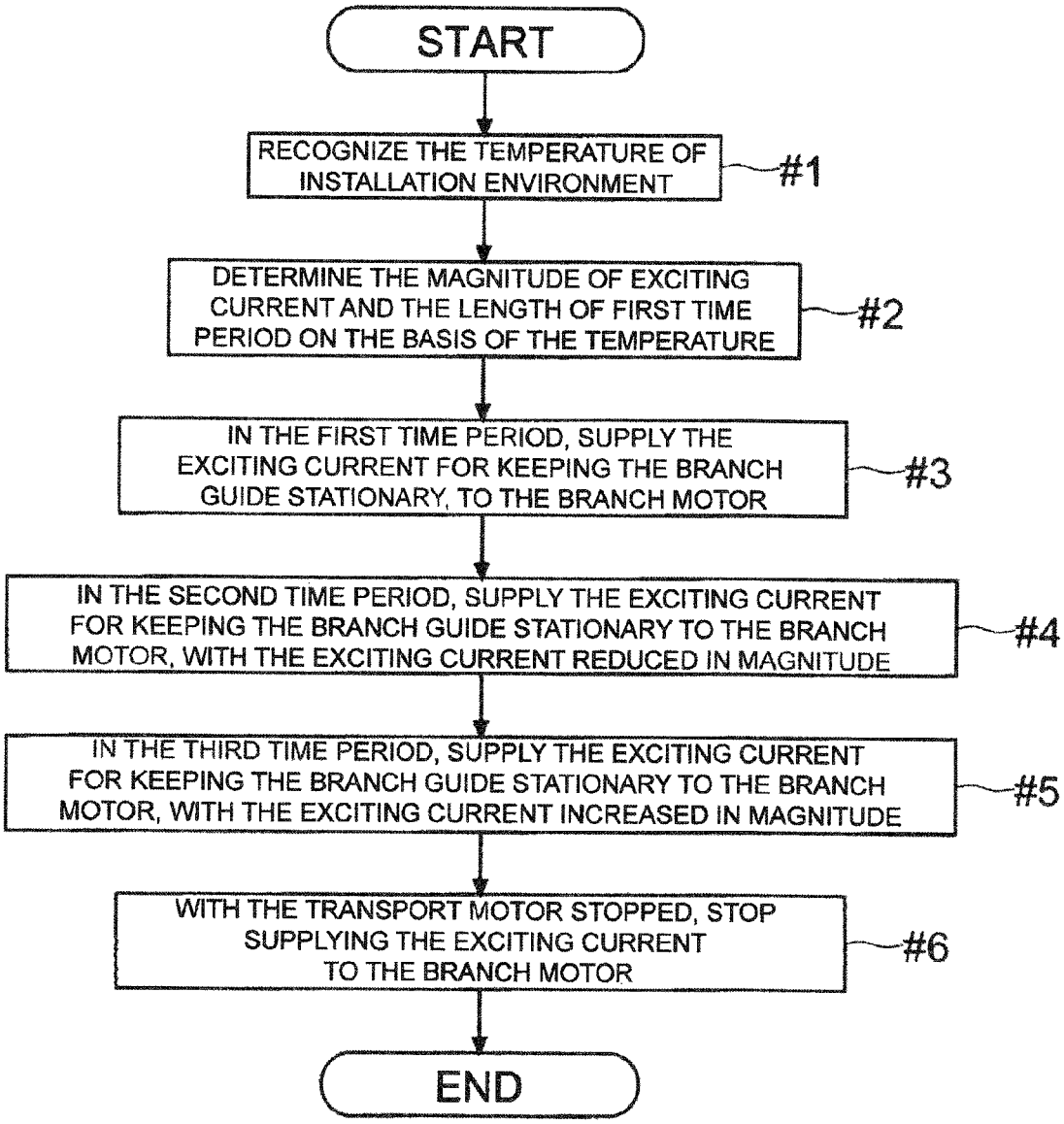
FIG. 9 is a flowchart illustrating an exemplary flow of supplying the exciting current to the branch motor at the time of keeping the branch guide stationary.

An exemplary flow of supplying an exciting current to the branch motor M7 at the time of keeping the branch guide 7 stationary will now be described with reference to FIG. 9. FIG. 9 is a flowchart illustrating an exemplary flow of supplying the exciting current to the branch motor at the time of keeping the branch guide stationary.

The process flow in FIG. 9 starts when rotation of the transport motor M2 is to be started. This includes both the case of causing the transport motor M2 to rotate in the positive direction and the case of causing it to rotate in the opposite direction for switching back.

In the case of reading one side of a document d, the position of the branch guide 7 is fixed from the beginning to the end of the job of reading one or more sheets of documents d. Therefore, at the time of single-sided reading of the document(s) d, the transport controlling unit 20 supplies to the branch motor M7 the exciting current for keeping the branch guide 7 stationary at the position where it guides the document(s) d onto the discharge tray 28, from the beginning to the end of the rotation of the transport motor M2.

On the other hand, at the time of double-sided reading, when it is necessary to rotate the branch guide 7, the transport controlling unit 20 cancels the stationary state of the branch motor M7, and supplies, to the branch motor M7, the exciting current of the magnitude that has been predetermined to be supplied to the branch motor M7 for causing the branch guide 7 to rotate, and a clock signal CL1 for the branch motor M7. When the branch guide 7 has rotated by the required angle, the transport controlling unit 20 resumes the stationary state of the branch guide 7 and supplies the exiting current for keeping it stationary to the branch motor M7 until the branch guide 7 is rotated next time.

The transport controlling unit 20 recognizes the temperature of the installation environment of the multifunctional peripheral 100 (the document transport device 2), on the basis of the output from the temperature sensor S1 (step #1). Then, on the basis of the temperature, the transport controlling unit 20 determines the magnitude of the exciting current supplied to the branch motor M7 for keeping the branch guide 7 stationary in each time period and the length of the first time period T1 (step #2).

Next, in the first time period T1 including the acceleration period of the transport motor M2, the transport controlling unit 20 supplies the exciting current (of the first current value A1) for keeping the branch guide 7 stationary, to the branch motor M7 (step #3). With the end of the first time period T1, in the second time period T2 including the stable period of the transport motor M2, the transport controlling unit 20 supplies the exciting current for keeping the branch guide 7 stationary to the branch motor M7, with the exciting current being reduced in magnitude (to the second current value A2) (step #4).

For the transport motor M2 to be stopped with the end of the transportation of the document, after the second time period T2 (following the step #4), in the third time period T3 including the deceleration period of the transport motor M2, the transport controlling unit 20 supplies the exciting current for keeping the branch guide 7 stationary to the branch motor M7, with the exciting current being increased in magnitude (to the third current value A3) (step #5).

Then, with the transport motor M2 stopped after the completion of reading of the document d, the transport controlling unit 20 stops supplying the exciting current to the branch motor M7 (step #6). This completes the processing of controlling the supply of the exciting current to the branch motor M7 during document reading and transportation (END).

As described above, the paper transport device 1 according to the embodiment includes: the transport rotary bodies (the transport roller pairs 26*a* to 26*c*, the discharge roller pair 27, the registration roller pair 25), the transport motor M2, the branch guide 7, the branch motor M7, and the processing unit (the transport controlling unit 20). The transport rotary bodies are rotated to transport a sheet of paper (a document d) along a path. The transport motor M2 rotates the transport rotary bodies. The branch guide 7 is rotated to switch between paper transport paths. The branch motor M7 rotates the branch guide 7. The processing unit controls rotation and stopping of the transport motor M2, rotation and stopping of the branch motor M7, and the magnitude of an exciting current supplied to the branch motor M7. While the sheet is transported with the rotation of the transport motor M2 started, in the case of keeping the branch guide 7 in a stationary state, in order to generate a holding torque in the branch motor M7 while the transport motor M2 is rotating, the processing unit performs control such that the exciting current of a first current value A1 is supplied to the branch motor M7 in a first time period T1 including the start of the rotation of the transport motor M2 and an acceleration period of the rotation, and such that the exciting current of a second current value A2, the absolute value of which is smaller than that of the first current value A1, is supplied to the branch motor M7 in a second time period T2 following the first time period T1 and including a stable period in which a rotational speed of the transport motor M2 is stable.

With this configuration, after a lapse of the first time period T1 (the time period with large torque) in which the rotation of the transport motor M2 is speeding up and the vibration caused by the transport motor M2 is large, when the second time period T2 is reached where the transport motor M2 rotates at a stable speed and thus the vibration caused thereby is stabilized, the magnitude of the exciting current supplied to the branch motor M7 is reduced to the second current value A2. This makes it possible to reduce the exciting current supplied to the branch motor M7 in accordance with the change in magnitude of the vibration caused by the transport motor M2, so the electric power consumed to keep the branch guide 7 in the stationary state can be reduced. Moreover, in the state where the vibration of the transport motor M2 is large, the exciting current is made large, while as the vibration of the transport motor M2 decreases, the exciting current is also reduced. Thus, despite the reduction of the power consumed in the branch motor M7, the branch guide 7 is kept stationary with accuracy, so the branch guide 7 can be prevented from swaying in that state, and the paper jamming otherwise caused thereby can be avoided.

Further, in the case of stopping the transport motor M2 that is rotating, the processing unit (the transport controlling unit 20) performs control such that the exciting current of a third current value A3, the absolute value of which is larger than that of the second current value A2, is supplied to the branch motor M7 in a third time period T3 including a deceleration period of the transport motor M2.

With this configuration, even when the vibration caused by the transport motor M2 becomes large as the rotational speed of the transport motor M2 is reduced, the exciting current supplied to the branch motor M7 is made large with the reduction of the rotational speed of the transport motor M2. Therefore, even if the vibration of the transport motor M2 becomes large at the time of deceleration, it is possible to reliably keep the branch guide 7 stationary and unmoved.

As the temperature decreases, larger torque tends to be required for rotating the transport rotary bodies (the transport roller pairs 26*a* to 26*c*, the discharge roller pair 27, the registration roller pair 25), because of various factors such as contraction of the resin members constituting the gears, contraction of the parts supporting the shafts of the rollers for transporting paper, hardening of the grease applied to the gears, and hardening of paper which makes bending thereof difficult. Further, as the torque required for rotating the transport motor M2 is larger, the vibration caused by the transport motor M2 is likely to become larger. Thus, the paper transport device 1 includes the temperature detecting body (the temperature sensor S1) configured to detect a temperature, and the processing unit (the transport controlling unit 20) performs control such that at least one of the absolute values of the first current value A1, the second current value A2, and the third current value A3 is increased as the temperature detected by the temperature detecting body is lower. With this configuration, in the situation where the vibration caused by the transport motor M2 is likely to become large as the torque for rotating the transport motor M2 has been made large, the exciting current supplied to the branch motor M7 can be increased to reliably keep the branch guide 7 stationary.

Further, the processing unit (the transport controlling unit 20) performs control to decrease the absolute value of the exciting current in a stepwise manner (gradually) in one or both of the case where the absolute value of the exciting current is decreased with transition from the first time period T1 to the second time period T2, and the case where the supply of the exciting current to the branch motor M7 is stopped with the stopping of the transport motor M2. With this configuration, it is possible to reduce the exciting current supplied to the branch motor M7 smoothly and quickly in accordance with the decrease of the vibration of the transport motor M2. This can efficiently reduce the power consumption.

Further, the branch guide 7 is a guide which controls whether or not to guide the sheet of paper (the document d) to the reverse transport path for reversing the front and back of the sheet, and in the case where the sheet is guided to the reverse transport path, the transport motor M2 rotates in a reverse direction, opposite to a positive direction, for reversing the front and back of the sheet, and then rotates in the positive direction again, for switching back the sheet.

With this configuration, the branch guide 7, which switches between the transport paths for reversing the front and back of the paper, can be kept stationary with accuracy when so required, with the power consumption reduced as compared with the conventional case.

The document transport device 2 includes the paper transport device 1 according to the embodiment. Therefore, it is possible to provide the document transport device 2 which enables the branch guide 7 to be kept stationary with accuracy when so required, with the reduced power consumed by the branch motor M7, thereby eliminating paper jamming at the branch guide 7. It is thus possible to provide an excellent document transport device 2 which consumes less power and makes fewer paper jam errors.

Further, the image forming apparatus (the multifunctional peripheral 100) includes the paper transport device 1 according to the embodiment. Therefore, it is possible to provide the image forming apparatus which enables the branch guide 7 to be kept stationary with accuracy when so required, with the reduced power consumed by the branch motor M7, thereby eliminating paper jamming at the branch guide 7. It is thus possible to provide an excellent image forming apparatus which consumes less power and makes fewer paper jam errors.

While the embodiment of the present disclosure has been described above, the scope of the present disclosure is not limited thereto; various modifications are possible in the implementation of the disclosure without departing from the gist thereof.

For example, the description was given above about the branch guide 7 and the branch motor M7 included in the document transport device 2. However, in the case where a motor for transporting a sheet of paper for printing, rotary bodies rotated by the motor, and a branch guide 7 and a branch motor M7 for double-sided printing are all arranged in a printing unit 5 disposed inside the main body of a multifunctional peripheral 100, then the present disclosure can be utilized for keeping the branch guide 7 stationary inside the main body of the multifunctional peripheral 100 and for reducing the power consumption therein.

The present disclosure is applicable to the paper transport device which uses a stepping motor to transport a sheet of paper, and the document transport device and the image forming apparatus which include the paper transport device.

What is claimed is:

1. A paper transport device comprising:

a transport rotary body rotated to transport a sheet of paper along a path;

a transport motor configured to rotate the transport rotary body;

a branch guide rotated to switch between paper transport paths;

a branch motor configured to rotate the branch guide; and a processing unit that controls rotation and stopping of the transport motor, rotation and stopping of the branch motor, and the magnitude of an exciting current supplied to the branch motor; wherein while the sheet is transported with the rotation of the transport motor started, in the case of keeping the branch guide in a stationary state, in order to generate a holding torque in the branch motor while the transport motor is rotating, the processing unit performs control such that the exciting current of a first current value is supplied to the branch motor in a first time period including the start of the rotation of the transport motor and an acceleration period of the rotation, and such that the exciting current of a second current value, the absolute value of which is smaller than that of the first current value, is supplied to the branch motor in a second time period following the first time period and including a stable period in which a rotational speed of the transport motor is stable.

2. The paper transport device according to claim 1, wherein in the case of stopping the transport motor that is rotating, the processing unit performs control such that the exciting current of a third current value, the absolute value of which is larger than that of the second current value, is supplied to the branch motor in a third time period including a deceleration period of the transport motor.

3. The paper transport device according to claim 2, further comprising a temperature detecting body configured to detect a temperature, wherein the processing unit performs control such that at least one of the absolute values of the first current value, the second current value, and the third current value is increased as the temperature detected by the temperature detecting body is lower.

4. The paper transport device according to claim 1, wherein the processing unit performs control to decrease the absolute value of the exciting current in a stepwise manner in one or both of the case where the absolute value of the exciting current is decreased with transition from the first time period to the second time period, and the case where the supply of the exciting current to the branch motor is stopped with the stopping of the transport motor.

5. The paper transport device according to claim 1, wherein the branch guide is a guide which controls whether or not to guide the sheet of paper to a reverse transport path for reversing the front and back of the sheet, and in the case where the sheet is guided to the reverse transport path, the transport motor rotates in a reverse direction, opposite to a positive direction, for reversing the front and back of the sheet, and then rotates in the positive direction again, for switching back the sheet.

6. A document transport device comprising the paper transport device according to claim 1.

7. An image forming apparatus comprising the paper transport device according to claim 1.

* * * * *